US006337662B1

(12) United States Patent
Cassel

(10) Patent No.: US 6,337,662 B1
(45) **Date of Patent: *Jan. 8, 2002**

(54) ANTENNA FOR RADIO COMMUNICATIONS APPARATUS

(75) Inventor: Erland Cassel, Sveastigen (SE)

(73) Assignee: Moteco AB, Ruda (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/403,865

(22) PCT Filed: Apr. 28, 1998

(86) PCT No.: PCT/SE98/00774

§ 371 Date: Oct. 28, 1999

§ 102(e) Date: Oct. 28, 1999

(87) PCT Pub. No.: WO98/49743

PCT Pub. Date: Nov. 5, 1998

(30) Foreign Application Priority Data

Apr. 30, 1997 (SE) ..... 9701646

(51) Int. Cl.[7] ..... H01Q 1/24

(52) U.S. Cl. ..... 343/702; 343/767; 343/806; 343/746; 343/700 MS

(58) Field of Search ..... 343/702, 767, 343/806, 746, 700 MS, 895

(56) References Cited

U.S. PATENT DOCUMENTS

| | | | | |
|---|---|---|---|---|
| 3,702,481 A | | 11/1972 | Koller et al. | 343/844 |
| 4,335,385 A | | 6/1982 | Hall | 343/700 MS |
| 4,398,199 A | | 8/1983 | Makimoto et al. | 343/700 MS |
| 4,443,802 A | * | 4/1984 | Mayes | 343/729 |
| 5,642,120 A | * | 6/1997 | Fujisawa | 343/702 |
| 5,754,143 A | | 5/1998 | Warnagiris et al. | 343/676 |
| 5,757,326 A | * | 5/1998 | Koyama et al. | 343/702 |
| 5,867,126 A | | 2/1999 | Kawahata et al. | 343/702 |
| 5,872,542 A | * | 2/1999 | Simons et al. | 343/700 MS |
| 5,914,693 A | * | 6/1999 | Takei et al. | 343/767 |
| 5,966,097 A | | 10/1999 | Fukasawa et al. | 343/700 MS |
| 6,005,524 A | * | 12/1999 | Hayes et al. | 343/702 |
| 6,040,803 A | | 3/2000 | Spall | 343/700 MS |

FOREIGN PATENT DOCUMENTS

AT 396 532 B 10/1993

OTHER PUBLICATIONS

PCT International Preliminary Examination Report.
PCT International Search Report.

* cited by examiner

*Primary Examiner*—Don Wong
*Assistant Examiner*—Tuyet T. Vo
(74) *Attorney, Agent, or Firm*—Smith, Gambrell & Russell, LLP

(57) ABSTRACT

An antenna for a radio communications apparatus operates in the frequency range of 800 MHz–3 GHz. The antenna has two radiating elements. The first radiating element is a slot in a substantially planar foil or disc-shaped metallic conductor. The second radiating element has a resonance frequency which is different from that of the first radiating element. The metallic conductor is placed close to a second conductor in the form of a metallic surface. The second radiating element is formed from an edge portion of the first conductor or a gap between the first and the second conductors. Capacitance devices may be disposed between the edge portion and the second conductor.

33 Claims, 3 Drawing Sheets

ANTENNA FOR RADIO COMMUNICATIONS APPARATUS

TECHNICAL FIELD

The present invention relates to an antenna for a radio communications apparatus operating in the frequency range of 800 MHz–3 GHz with a first radiating element in the form of a slot in a substantially planar foil or disc-shaped metal conductor, and a second radiating element set to a different resonance frequency from the first element.

BACKGROUND ART

In the employment of mobile radio communications apparatuses, in daily parlance mobile telephones in an urban environment, problems are often encountered in transmission and receiving. The reason for this is that, in such an environment, there are often dead zones which cannot be reached in communication with a certain cell in the system.

In order to remedy this problem, use is often made of duplicated antennae in mobile telephones, these antennae having different directive effect, polarisation and/or appearance on the antenna lobe. Such a second antenna is often entitled a diversity antenna.

Swedish Patent Application No. 9701646-3 describes a diversity antenna which is designed as a double so-called F-antenna (often called a notch antenna, slot antenna or slit antenna). The pertinent antenna includes a double-sided, L-shaped circuit card where the radiating slots are disposed in the metallic conductor layers disposed on the opposing sides of the circuit card. The slots have meandering formation so as to reduce the physical construction size of the antenna. Further, both of the slots are set to different resonance frequencies.

The antenna construction described in Swedish Patent Application No. 9701646-3 is intended for integration in a so-called mobile telephone. Here, the manifest trend moves towards smaller physical dimensions, from which it follows that the space for the antenna will be less and less, the further this development trend moves.

Because of the slight space available, it often happens that the antenna will be placed immediately outside and more or less parallel with a metal plane. The metal plane may consist of a carrying metal body which imparts firmness to the chassis of the telephone, of a screen plate or of the earth plane in an electronic card. By coupling and reflection, the properties of the antenna are greatly influenced if it is placed too close to such a metal plane. The free radiation is affected, as well as other properties such as, for example, impedance adaptation between antenna input and antenna cable across the antenna's working frequency range and the antenna's degree of efficiency, etc.

The above described problems begin to become considerable when the distance between the antenna and the metal surface approaches a tenth of a wavelength. In shorter distances, the function of the antenna increasingly deteriorates in order subsequently to be no longer acceptable.

PROBLEM STRUCTURE

The present invention has for its object to design the antenna disclosed by way of introduction such that it will be suited for use even in extremely cramped spaces. Thus, the present invention has for its object to design the antenna such that, with retained good function and high degree of efficiency, it may be placed extremely close to a metal plane disposed in a radio communications apparatus. The present invention further has for its object to design the antenna such that it will have good directive effect, good efficiency and above all extremely small dimensions, as well as good band width capability.

SOLUTION

The objects forming the basis of the present invention will be attained if the antenna intimated by way of introduction is characterized in that the metallic conductor is placed close to a second conductor in the form of a metallic surface, and that the second radiating element is formed from an edge portion of the first conductor or a gap or an interstice between this edge portion and the second conductor.

Further advantages will be attained if the antenna is also given one or more of the characterizing features as set forth in appended claims 2 to 13.

BRIEF DESCRIPTION OF THE ACCOMPANYING DRAWINGS

The present invention will now be described in greater detail hereinbelow, with reference to the accompanying Drawings. In the accompanying Drawings.

DESCRIPTION OF PREFERRED EMBODIMENTS

In the body of this specification and in the claims, the term radiating element will be employed. This should be interpreted as an element which has the capability of both radiating and receiving electromagnetic energy within the frequency range or ranges in which the radio communications apparatus is intended to operate.

When the body of this specification and the claims disclose that a distance is slight, this implies that the distance is slight in relation to the wavelength for which the antenna is set. In those cases where several frequency settings occur, a mean value of the wavelengths is intended.

Figure 1:
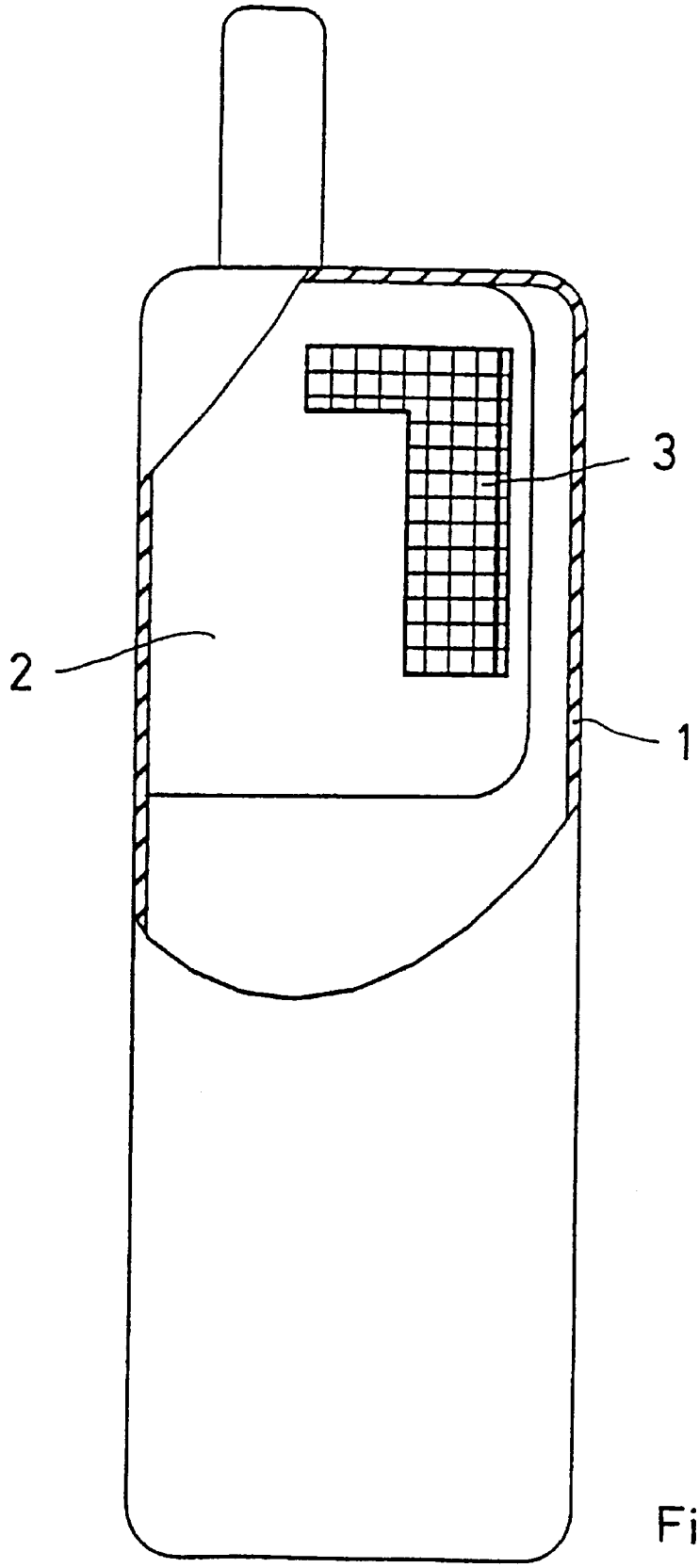
FIG. 1 shows the placing of the antenna according to the present invention interiorly in a mobile telephone.

FIG. 1 shows, in the partly cut-away state, a radio communications apparatus in which the present invention will be employed. The radio communications apparatus is often called in daily parlance a mobile telephone and this terminology will be employed herein.

The mobile telephone has an outer casing 1 which encloses the components included in the mobile telephone. In the upper region of the outer casing, there is disposed a metal plane 2 which, in practice, may consist of a bearing metal body which imparts rigidity to the chassis of the mobile telephone, of a screen plate or of an earth plane to an electronic card. Possibly, the plane 2 may also consist of an assembly plate which serves for mounting the antenna 3 proper and which, together with the antenna 3, is mounted in the space intended therefor inside the casing 1.

In FIG. 1, all parts of the illustrated antenna 3 are absent, and these will be described in greater detail below. FIG. 1 is, therefore, intended merely to show the placing of the antenna in the outer casing 1, and also its location in relation to the metal plane 2. It will also be apparent from the Figure that the metal plane 2 is of larger, or at least equal, surface extent as the antenna 3.

While not being apparent from FIG. 1, the antenna 3 is substantially planar and disc-shaped and is disposed approximately parallel with and in slight spaced apart relationship to the metal plane 2.

Figure 2:
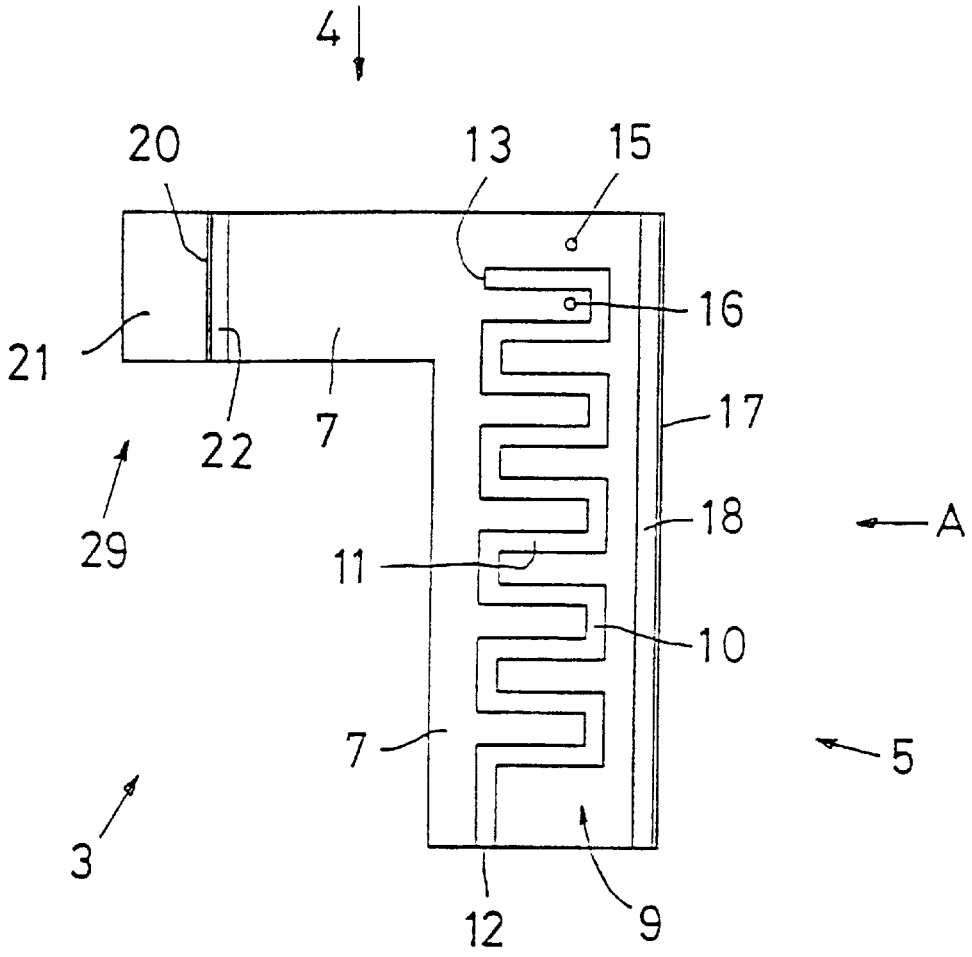
FIG. 2 shows the antenna of FIG. 1 on a larger scale.
Figure 3:
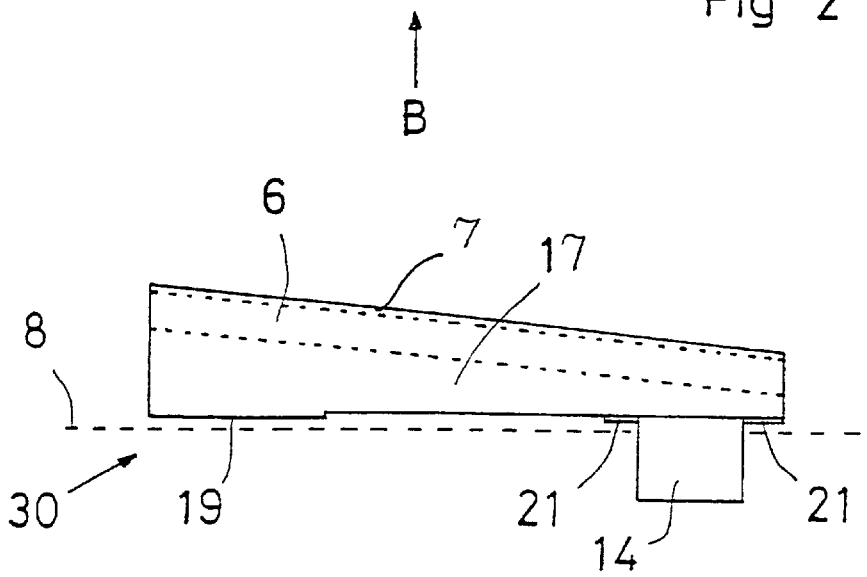
FIG. 3 shows the antenna of FIG. 2 seen in the direction of the arrow A.
Figure 4:
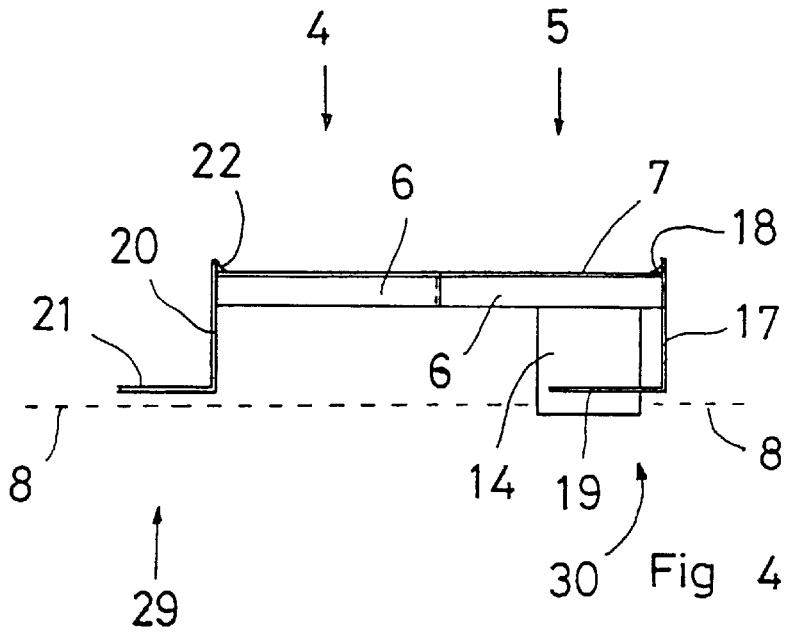
FIG. 4 shows the antenna of FIG. 2 seen in the direction of the arrow B.

FIG. 2 shows the antenna 3 in plan view and in the same orientation as in FIG. 1. The antenna 3 includes two mutually interconnected rectangular parts 4 and 5 which are preferably of one piece manufacture and which together constitute the form of an inverted 'L'. On that side of FIG. 2 facing towards the observer, i.e. the side facing away from the metal plate 2, the antenna has an electrically conductive metal foil, which is carried on a disc-shaped carrier 6 of electrically insulating and non-magnetic material. The foil or the electric conductor on the carrier 6 has reference numeral 7 and will also be mentioned as a first conductor. The metal plane 2 illustrated in FIG. 1 is shown in FIGS. 3 and 4 by broken lines 8 and will also be designated a second conductor. The second conductor 8 may also be realised as a separate, metallic surface, preferably in substantially planar sheet material which may, moreover, be employed as an auxiliary in mounting the antenna 3. Preferably, the second conductor 8 is connected to earth in the radio communications apparatus, for example via the metal plane 2.

The first conductor 7 covers the entire side of the carrier 6 facing away from the metal plane 2 or the second conductor 8, and is provided with a first radiating element in the form of a slot 9. In the illustrated embodiment, the slot 9 is designed with meander-shaped formations which are composed of alternatingly longer 11 and shorter 10 slot portions, which are arranged at approximately mutual right angles.

The slot 9 or the first radiating element is, in the embodiment illustrated in FIG. 2, set to a quarter wavelength and has, therefore, an open end 12 and a closed end 13. The slot 9 is supplied in the proximity of the dosed end 13 via a terminal 14 (FIGS. 3 and 4) which has connections 15 and 16 in the first conductor 7.

According to the present invention, it is also possible to set the slot 9 to half-wave resonance, in which event the length of the slot will be correspondingly longer and both ends closed, analogous with the closed end 13 illustrated in FIG. 2

The foil-shaped first conductor 7 extends unbroken into the smaller or first rectangular part 4 of the antenna and covers it. This part of the first conductor 7 is to be considered as an earth plane for the first radiating element 9.

Along the right-hand edge of the second or larger rectangular part 5 of the antenna in FIG. 2, there extends an elongate plate 17 which is galvanically connected to the first conductor 7 throughout the entire connection length. In FIGS. 2 and 4, an elongate solder joint 18 is intimated which extends throughout the entire length of the elongate plate 17.

An alternative method of connecting the elongate plate 17 and the firsts conductor 7 entails that the elongate plate 17, along its edge, is provided with a number of fingers, pins or projections which extend through corresponding bores or holes in the carrier 6 in order subsequently to be soldered in place in the first conductor 7 on the outside of the antenna (that side in FIG. 2 facing towards the observer).

The elongate plate 17 has its plane of extent transversely directed, and preferably also at right angles, to the plane of extent of the first conductor 7. This is clearly apparent from FIG. 4. Further, the plate 17 is, throughout its entire length, of greater width than the thickness of the carrier 6. The plate 17 also functions as a magnification of the earth plane of the slot 9.

In its end facing away from the terminal 14, the elongate plate 17 has a tongue 19 which extends approximately at right angles in relation to the plate 17 proper and parallel with the carrier 6 in under it. The tongue 19, which extends galvanically discrete from, but along the metal plane 2 (or, in FIGS. 3 and 4, the second conductor 8), forms a capacitance device 30 between the first conductor 7 and the second conductor 8. The tongue 19 or capacitance device constitutes an impedance adaptation between the antenna 3 and its earth plane.

As far as the antenna has been described above, it has been described as an antenna set for a limited frequency band. If the frequency is changed so that it falls outside this range setting, the slot 9, i.e. the first radiating element, will move increasingly out of resonance. When this occurs, the slot 9 will generate currents along the edges of the first conductor 7. Consequently, the slot 9 supplies the edges of the first conductor, which will then obtain the function of a second radiating element.

Another method of describing this phenomenon implies that, because of the short distance between these conductors, there are formed, between the edges of the first conductor 7 and the second conductor 8 slots which may be considered as radiating elements (a second radiating element).

The distance between the edges of the first conductor 7 and the second conductor 8 (possibly the metal plate 2) is slight, which in this context entails a value of the order of magnitude of 0.005–0.1 wavelengths, and often approx. 0.01 wavelengths.

Regardless of which reasoning is applied, the edges or alternatively the gaps are shorter than a quarter wavelength, for which reason the second radiating element must be loaded with a capacitance relative to the second conductor 8. For this reason, there is disposed, between edge portions of the first conductor 7 and the second conductor 8, one or more capacitance devices 29 for impedance adaptation of the second radiating element.

In the embodiment illustrated in FIGS. 2–4, the capacitance device 29 is galvanically connected to edge portions or one edge portion of the first conductor 7 and has a first portion 20 which extends from the first conductor 7 in a direction towards the second conductor 8. A slight distance from this, the capacitance device 29 has a second portion 21 in the form of a plate which is galvanically discrete from the second conductor 8 but which extends along it a relatively short distance therefrom. Possibly, there may be disposed, between the second portion 21 and the second conductor 8, a dielectric, for example in the form of double sided adhesive tape.

In a corresponding manner, a double sided adhesive tape may be disposed between the tongue 19 on the elongate plate 17 and the second conductor 8.

In one alternative embodiment, which will be described more closely below, the reverse arrangement may also apply, such that the capacitance device is galvanically connected to the second conductor 8 and has a first portion which extends towards the first conductor 7 and a second portion which is galvanically discrete from the first conductor but which extends along it a short distance.

In FIG. 2, the first portion 20 of the capacitance device 29 is illustrated as secured in the first conductor 7 by means of a solder 22. The interconnection between the capacitance device and the first conductor 7 is, therefore, entirely analogous with the interconnection between the first conductor 7 and the elongate plate 17.

In the embodiment illustrated in FIGS. 2–4, the capacitance device 29 is placed along the end edge of the first rectangular part 4 facing away from the elongate plate 17. In the illustrated embodiment, the second plate shaped portion 21 extends out from this end edge. In one variation, the second portion may, however, also extend in under the rectangular part 4.

In the embodiment illustrated in FIGS. 2–4, additional capacitance devices may possibly be employed at other places along the edge portion of the antenna.

Figure 5:
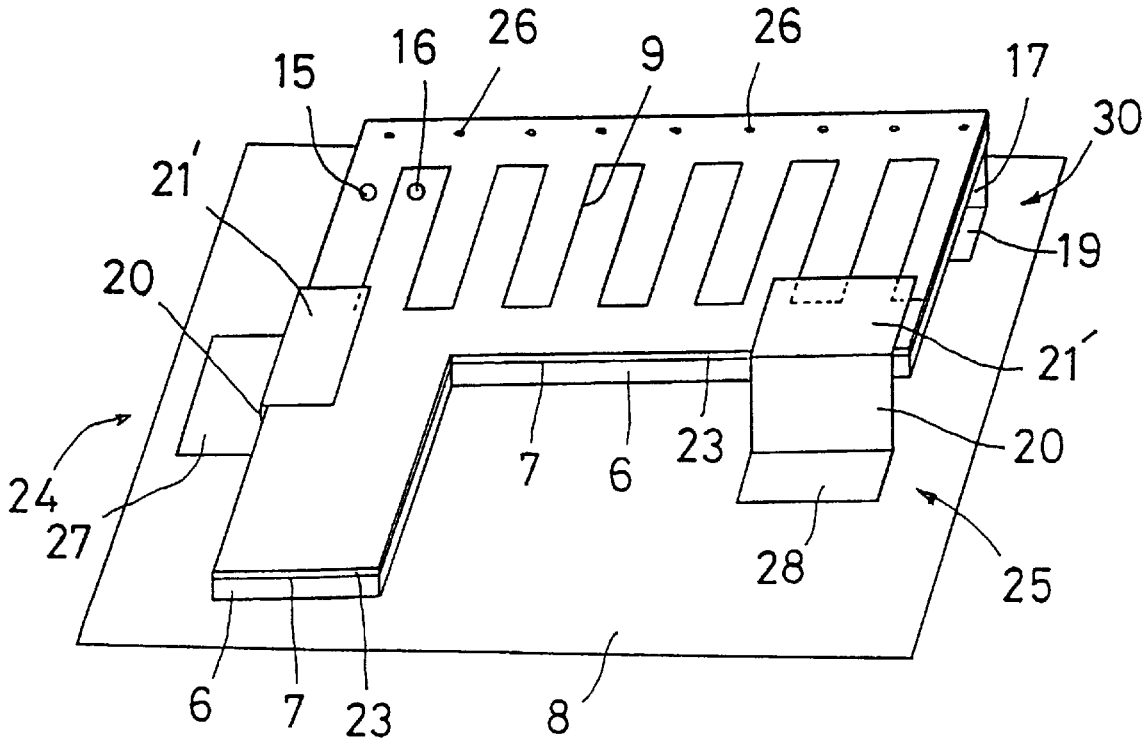
FIG. 5 shows a modified embodiment of the antenna.

FIG. 5 shows a slightly modified embodiment of the present invention. In this embodiment, the carrier 6 has the first conductor 7 located under a layer 23 of insulating non-magnetic material. The layer 23 serves to realise a suitable gap between the overlapping portions of the capacitance devices 24 and 25 and the first conductor 7.

Wholly analogous with that described above, the antenna according to FIG. 5 has a radiating first element designed as a slot 9. The slot 9 may be designed both as a quarter wave slot and as a half wave slot. Analogous with that described above, the slot is supplied via connections 15 and 16. The elongate plate 17 is, in this embodiment, provided with upwardly directed pins, plugs or projections which are passed through bores in the carrier 6 and are soldered in place on the first conductor 7. This is illustrated in FIG. 5 by solder points 26 visible through the layer 23.

FIG. 5 also shows the tongue 19 of the elongate plate 17 located a slight distance from the second conductor 8, and which may also be secured in the second conductor 8 via an electrically insulating, non-magnetic, double sided adhesive tape which functions as spacer material.

The capacitance device 25 is, as will be apparent from a comparison between FIGS. 1 and 5, placed in a lower portion of the left-hand edge of the larger rectangular part 5 in FIG. 1. The capacitance device 24 is placed at the transition region between the two rectangular parts 4 and 5, as a result, is located at the upper edge of the antenna if FIG. 1.

Both of the capacitance devices 24 and 25 are designed in approximately the same manner and have anchorage plates 27 and 28, respectively, which are galvanically interconnected, for example by soldering, to the second conductor 8. From these anchorage plates 27 and 28, first portions 20 of the two capacitance devices extend towards the first conductor 7. From their upper edges, plate shaped second portions 21 are angled in over the antenna and are galvanically discrete from the first conductor 7 but extend along it. In one practical version, the insulating layer 23 functions as spacer material and, for example, the plate shaped second portions 21 may be glued in it.

Also in the embodiment according to FIG. 5, additional capacitance devices may be provided and possibly the capacitance devices 24 and 25 shown on the Drawing may need to be varied in size or placing compared with that shown on the Drawing, with a view to realising the correct impedance adaptation.

While it is not apparent from the Drawings, it is possible to provide an electrically insulating, non-magnetic material between the carrier 6 and the second conductor 8. This electrically insulating material may be employed as spacer material and as assembly auxiliary for the antenna proper. In electric terms, this spacer material realises an apparent increase of the distance between the second conductor 8 and the antenna.

What is claimed is:

1. An antenna for a radio communications apparatus operating in the frequency range of 800 MHz–3 GHz with a first radiating element in the form of a slot (9) in a substantially planar foil or disc-shaped metallic conductor (7), and a second radiating element set to a different resonance frequency from the first element, characterized in that the metallic conductor (7) is placed close to a second conductor (8) in the form of a metallic surface; and that the second radiating element is formed from an edge portion of the first conductor (7) or a gap or interstice between the edge portion of the first conductor and the second conductor (8).

2. The antenna as claimed in claim 1, characterized in that capacitance devices (24, 25, 29, 30) are disposed between the edge portion of the first conductor and the second conductor (8).

3. The antenna as claimed in claim 1, characterized in that the distance between the first (7) and the second (8) conductors is of the order of magnitude of 0.005–0.1 wavelengths.

4. The antenna as claimed in claim 1, characterized in that the second conductor (8) has the same or larger surface extent than the first conductor (7).

5. The antenna as claimed in claim 1, characterized in that the slot (9) in the first conductor (7) has windings, meander formations or is zig-zag shaped.

6. The antenna as claimed in claim 1, characterized in that the first conductor (7) is foil shaped and is disposed on a carrier (6) of electrically insulating, non-magnetic material, and located on the side of the carrier (6) facing away from the second conductor (8).

7. The antenna as claimed in claim 1, characterized in that the slot (9) has a length of one quarter wavelength, the slot having one open (12) and one closed (13) end.

8. The antenna as claimed in claim 1, characterized in that the slot has a length of one half wavelength, both ends of the slot being closed.

9. The antenna as claimed in claim 1, characterized in that the first conductor (7) is in the form of an L, the slot (9) being disposed in the longer shank (5) of the L.

10. The antenna as claimed in claim 1, characterized in that a capacitance device (29, 30) is galvanically connected at an edge region of the first conductor (7), has a first portion (17, 20) which extends towards the second conductor (8) and a second portion (19, 21) which is galvanically discrete from and extends along the second conductor (8).

11. The antenna as claimed in claim 1, characterized in that a capacitance device (24, 25) is galvanically connected to the second conductor (8), has a first portion (20) which extends towards the first conductor (7) and a second portion (21) which is galvanically discrete from and extends along an edge portion of the first conductor (7).

12. The antenna as claimed in claim 1, characterized in that a plurality of capacitance devices (24, 25, 29, 30) are disposed between the first (7) and the second (8) conductor.

13. The antenna as claimed in claim 1, characterized in that an electrically insulating, non-magnetic material is disposed between the carrier (6) and the second conductor (8).

14. The antenna as claimed in claim 1, characterized in that the second conductor (8) is substantially planar.

15. An antenna for a radio communications apparatus operating in the frequency range of 800 MHz–GHz comprising:

a first conductor in the shape of a substantially planar metal foil or disc, said first conductor having an edge portion, a first radiating element in the shape of a slot formed in the first conductor, a second conductor in the shape of a metallic surface located close to the first conductor and being galvanically discreet relative to said first conductor, and a second radiating element tuned to a resonance frequency different from the resonance frequency of the first radiating element, said second radiating element being formed from the edge portion of said first conductor or a gap or interstice between said first conductor and the second conductor.

16. The antenna as claimed in claim 15, characterized in that capacitance devices are disposed between the edge portion of the first conductor and the second conductor.

17. The antenna as claimed in claim 15, characterized in that the distance between the first and the second conductors is of the order of magnitude of 0.005–0.1 of a wavelength.

18. The antenna as claimed in claim 15, characterized in that the second conductor has the same or larger surface extent than the first conductor.

19. The antenna as claimed in claim 15, characterized in that the slot in the first conductor has windings, meander formations or is zig-zag shaped; and characterized in that the first conductor is foil shaped and is disposed on a carrier of electrically insulating, non-magnetic material, and said first conductor is located on the side of the carrier facing away from the second conductor.

20. The antenna as claimed claim 15, characterized in that the slot has a length of one quarter wavelength, the slot having one open and one closed end.

21. The antenna as claimed in claim 15, characterized in that a capacitance device is galvanically connected at an edge region of the first conductor, has a first portion which extends towards the second conductor and a second portion which is galvanically discrete from and extends along the second conductor.

22. The antenna as claimed in claim 15, characterized in that a capacitance device is galvanically connected to the second conductor, has a first portion which extends towards the first conductor and a second portion which is galvanically discrete from and extends along an edge portion of the first conductor.

23. The antenna as claimed in claim 15, characterized in that a plurality of capacitance devices are disposed between the first and the second conductor.

24. The antenna as claimed in claim 15, characterized in that an electrically insulating, non-magnetic material is disposed between the carrier (6) and the second conductor (8).

25. An antenna for a radio communications apparatus operating in the frequency range of 800 MHz–3 GHz comprising:

a first conductor in the shape of a substantially planar metal foil or disc, said first conductor having an edge portion;

a first radiating element in the shape of a slot formed in the first conductor;

a second conductor in the shape of a metallic surface, an elongate metal plate galvanically connected to the first conductor along the edge portion thereof and extending towards the second conductor, and a second radiating element formed by a slot between the second conductor and an adjacent edge of the elongate metal plate.

26. An antenna as claimed in claim 25 wherein said elongate metal plate is soldered along an elongated length of said metal plate to said first conductor.

27. An antenna as claimed in claim 25 wherein said elongated metal plate is connected by pins that connect said first conductor in an end region of said elongate metal plate.

28. The antenna as claimed in claim 25, characterized in that capacitance devices are disposed between the edge portion of the first conductor and the second conductor; and characterized in that the distance between the first and the second conductors is of the order of magnitude of 0.005–0.1 of a wavelength.

29. The antenna as claimed in claim 25, characterized in that the second conductor has the same or larger surface extent than the first conductor; and characterized in that the slot in the first conductor has windings, meander formations or is zig-zag shaped.

30. The antenna as claimed in claim 25, characterized in that the first conductor is foil shaped and is disposed on a carrier of electrically insulating, non-magnetic material, and located on the side of the carrier facing away from the second conductor.

31. The antenna as claimed in claim 25, characterized in that the slot has a length of one quarter wavelength, the slot having one open and one closed end.

32. The antenna as claimed in claim 25, characterized in that a capacitance device is galvanically connected at an edge region of the first conductor, has a first portion which extends towards the second conductor and a second portion which is galvanically discrete from and extends along the second conductor.

33. The antenna as claimed in claim 25, characterized in that a capacitance device is galvanically connected to the second conductor, has a first portion which extends towards the first conductor and a second portion which is galvanically discrete from and extends along an edge portion of the first conductor.

* * * * *